US008177192B1

(12) United States Patent
Taylor et al.

(10) Patent No.: US 8,177,192 B1
(45) Date of Patent: May 15, 2012

(54) HAMMER WITH CONCEALED ADJUSTABLE FULCRUM

(76) Inventors: Warren L. Taylor, Port Angeles, WA (US); Martin J. Marchant, Port Angeles, WA (US)

( * ) Notice: Subject to any disclaimer, the term of this patent is extended or adjusted under 35 U.S.C. 154(b) by 364 days.

(21) Appl. No.: 12/592,555

(22) Filed: Nov. 25, 2009

(51) Int. Cl.
*B25D 1/04* (2006.01)
*B25C 11/00* (2006.01)

(52) U.S. Cl. ..... 254/26 E; 81/20

(58) Field of Classification Search .... 81/20; 254/26 E, 254/26 R
See application file for complete search history.

(56) References Cited

U.S. PATENT DOCUMENTS

| | | | | | |
|---|---|---|---|---|---|
| 540,967 | A | * | 6/1895 | McClelan | 254/26 E |
| 2,589,046 | A | * | 3/1952 | Brown et al. | 254/26 E |
| 2,589,047 | A | * | 3/1952 | Brown et al. | 254/26 E |
| 2,741,456 | A | * | 4/1956 | Williams | 254/26 E |
| 4,422,620 | A | | 12/1983 | Nitzberg | |
| 4,998,996 | A | | 3/1991 | Belanger | |
| 5,060,911 | A | | 10/1991 | Mikesell | |
| 5,249,776 | A | | 10/1993 | Johnson | |
| 5,441,236 | A | | 8/1995 | Kiernan | |
| 6,827,333 | B1 | | 12/2004 | Lutz | |
| 7,051,998 | B2 | | 5/2006 | Sleiman | |
| 7,299,717 | B2 | | 11/2007 | Chen | |
| 2004/0227132 | A1 | | 11/2004 | Harala | |
| 2007/0186727 | A1 | | 8/2007 | Casolco | |

* cited by examiner

*Primary Examiner* — David B Thomas
(74) *Attorney, Agent, or Firm* — Virginia P. Shogren

(57) ABSTRACT

A hammer with concealed adjustable fulcrum having a pivot region recess in the head, a tab slide recess in the handle, and a shaft opening formed within the head and handle. An extension rod with distal end shaped to form a rocker plate capable of flush recession within the pivot region opening is slidably adjustable within the shaft opening. Single-handed manual depression of a release tab bends a spring steel tab into the shaft opening to slide a T-clip out of a T-guide recess opening for slidable adjustment of the rod and rocker plate to one of a plurality of possible positions. Conversely, manual release of the tab causes the spring steel tab to bend towards the tab slide region thereby inserting the T-clip into a T-guide recess to lock the rod and corresponding rocker plate into a desired position.

15 Claims, 9 Drawing Sheets

HAMMER WITH CONCEALED ADJUSTABLE FULCRUM

FIELD OF THE INVENTION

This invention relates generally to hammer tool devices, and more particularly to a claw hammer having a fully concealed but extendable fulcrum recessed within the hammer head and slidably adjustable through single-handed application of manual (thumb) pressure and axial movement of a release tab on the hammer handle.

BACKGROUND OF THE. INVENTION

Use of recycled lumber and wood products is a growing market. As a result, carpenters and typical consumers are increasingly using recycled lumber requiring the added task of removing nails prior to re-use. Many nails in recycled lumber are deeply embedded in the wood, making nail extraction difficult.

Claw hammers are used to remove partially extended nails or other fasteners from wood or other materials. A typical claw hammer has a fixed fulcrum pivot point on the outer curve of the hammer head against which the hammer is pivoted when removing nails or other fasteners. When removing a nail, the nail shaft is slidably inserted within the cleft opening of a two-pronged claw. The claw slides along the nail shaft until it meets with and catches the nail head.

The distance between the pivot point, on the one hand, and where the claw engages the nail shaft and/or head, on the other hand, corresponds to the amount of torque and resulting force that can be applied to the nail. A smaller distance increases the torque and force available and makes nail removal easier for the hammer user. For extended nails, the pivot point is shifted away (at a further distance) from the nail shaft. As a result, the user either struggles through multiple attempts to remove the nail, and/or cannot, for lack of strength, create sufficient torque to remove the nail.

To date, devices developed to extend a hammer's fulcrum are addressed at assisting in the removal of recently and/or partially-embedded nails in the course of working with new lumber. These tools do not meet the needs of carpenters or consumers removing deeply embedded nails from recycled lumber. Additional drawbacks include: 1) designs utilizing excessive parts and small parts that are subject to rust damage; 2) designs that require awkward, time consuming adjustment of the fulcrum that render the tool non-practical; 3) designs that allow for a fulcrum to be extended to only one length so as to render the fulcrum unusable for multiple nail lengths; 4) designs which give the hammer an unusual appearance that will lead to consumer rejection; 5) designs that incorporate external parts, knobs, and so forth, that interfere with normal use of the hammer tool; 6) designs that require two hands for fulcrum extension and/or adjustment, thereby creating a potential safety hazard for a user who needs at least one hand to remain stabilized while using the tool; 7) designs that incorporate custom expensive parts that would render the tool too expensive for the typical consumer; and, 8) designs that require too much strength to extend and/or adjust the fulcrum, thereby rendering the tool too difficult to use by many potential consumers.

Accordingly, there is an as of yet unmet need in the art for a hammer design to increase torque for nail and fastener removal that: 1) does not require excessive or small parts subject to rust damage; 2) does not require awkward, time consuming adjustment of a fulcrum; 3) that allows for a fulcrum to be extended to multiple lengths for multiple nail extension lengths, such as is necessary when working with recycled lumber that contains many deeply embedded nails; 4) that does not give the hammer an unusual appearance that would lead to consumer rejection; 5) that does not incorporate external parts that would interfere with normal use of the hammer tool; 6) that does not require two hands for fulcrum extension and/or adjustment and can be used single-handedly, thereby allowing the user to remain stabilized in the work environment for improved safety; 7) that does not incorporate custom expensive parts that would render the tool too expensive for the typical consumer; and, 8) that incorporates a fulcrum that is easy and quick to adjust without requiring much time or strength.

THE INVENTION

Summary of the Invention

The inventive Hammer With Concealed Adjustable Fulcrum of this application comprises a head with a face, a claw, and a pivot region opening, a handle fixed to the head comprising a tab slide region opening, a shaft opening formed within the head and handle, and an extension rod having a first distal end and a second proximal end. The first end of the rod is shaped to form a rocker plate capable of flush recession within the pivot region opening. The second end of the rod is shaped for slidable insertion within the shaft opening.

An elongated spring tab is affixed proximate the second end of the rod. A release tab and T-clip are affixed proximate a base end of the spring tab. The release tab extends laterally through the tab slide opening. The T-clip is shaped for insertion, retention and release both into and out of a plurality of spaced T-guide recesses formed between opposed, spaced T-guides affixed to the shaft opening and extending internally into the shaft opening.

In operation, single-handed manual depression of the release tab (by a user's thumb) bends the spring tab into the shaft opening and removes the T-clip from a T-guide recess allowing manual axial movement of the release tab with corresponding slidable adjustment of the rod and rocker plate to a desired position. Conversely, manual release of the release tab causes the spring tab to bend towards the tab slide region thereby inserting the T-clip into a T-guide recess to lock the rod and corresponding rocker plate into a desired position.

BRIEF DESCRIPTION OF THE DRAWINGS

The invention is described in more detail with reference to the attached drawings, in which.

DETAILED DESCRIPTION OF THE ILLUSTRATIVE EMBODIMENT

The following detailed description illustrates the invention by way of example, not by way of limitation of the scope, equivalents or principles of the invention. This description will clearly enable one skilled in the art to make and use the invention, and describes several embodiments, adaptations, variations, alternatives and uses of the invention.

In this regard, the invention is illustrated in the several figures, and is of sufficient complexity that the many parts, interrelationships, and sub-combinations thereof simply cannot be fully illustrated in a single patent-type drawing. For clarity and conciseness, several of the diagrams show in schematic, or omit, parts that are not essential in that diagram to a description of a particular feature, aspect or principle of the invention being disclosed. Thus, the best mode embodiment of one feature may be shown in one diagram, and the best mode of another feature will be called out in another diagram.

Hammer with Concealed Adjustable Fulcrum

Figure 1:
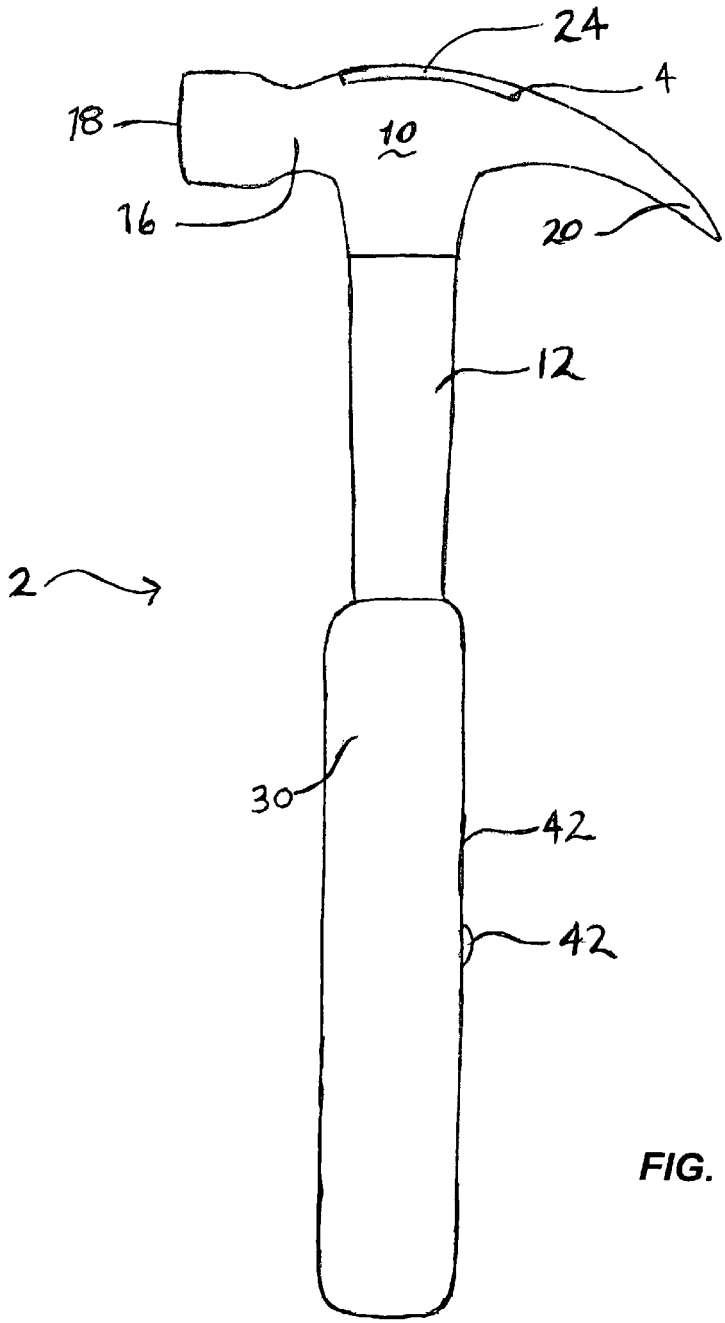
FIG. 1 is a side elevation view of the device with fulcrum retracted, according to the invention.

FIG. 1 shows the device 2 with fulcrum 24 retracted, according to the invention. As shown in FIG. 1, the device 2 has the shape and appearance of a typical claw hammer. The hammer 2 includes a typical head 10 with face 18, neck 16 and claw 20. At the top margin of the head 10, a rocker plate 24 is retracted into a pivot region opening 4. In the preferred embodiment, the pivot region opening 4 is a shallow, concave, generally rectangular-shaped recess formed within the top margin of the head 10. The rocker plate 24 is curved to form a flush margin when retracted within the pivot region opening 4. Alternately, the rocker plate 24 may be planar, such as when the top margin of the head 10 is planar and not curved.

The hammer 2 as shown in FIG. 1 is a common nail hammer with curved dual-pronged claw 20. However, any desired or suitable type of hammer may be manufactured or altered to include the concealed adjustable fulcrum of the present invention, including without limitation, a rip hammer with a straight claw, a framing hammer, a finishing hammer, or a tack hammer with claw head. The hammer 2 may be of any desired or suitable length or size and may be constructed out of any suitable or desired materials, including wood, metals or a combination thereof.

Referring to FIG. 1, the handle 12 of the hammer 2 is coated in a rubberized gripping material 30 and has been modified to include a tab slide region 40. In the preferred embodiment, the tab slide region 40 is a shallow elongated generally oval-shaped recess formed in the rubberized gripping material 30 covering the handle 12. Within the tab slide region 40, the handle includes a recessed generally planar release tab 42 shaped for easy manual depression by a user's thumb as shown more in detail in connection with FIGS. 3B-3D. The recessed tab slide region 40 and release tab 42 do not interfere with normal use and operation of the hammer device 2. The recessed rocker plate 24, tab slide region 40 and release tab 42 conceal the adjustable fulcrum and give the hammer 2 the appearance of a typical nail hammer with curved claw 20.

Figure 2:
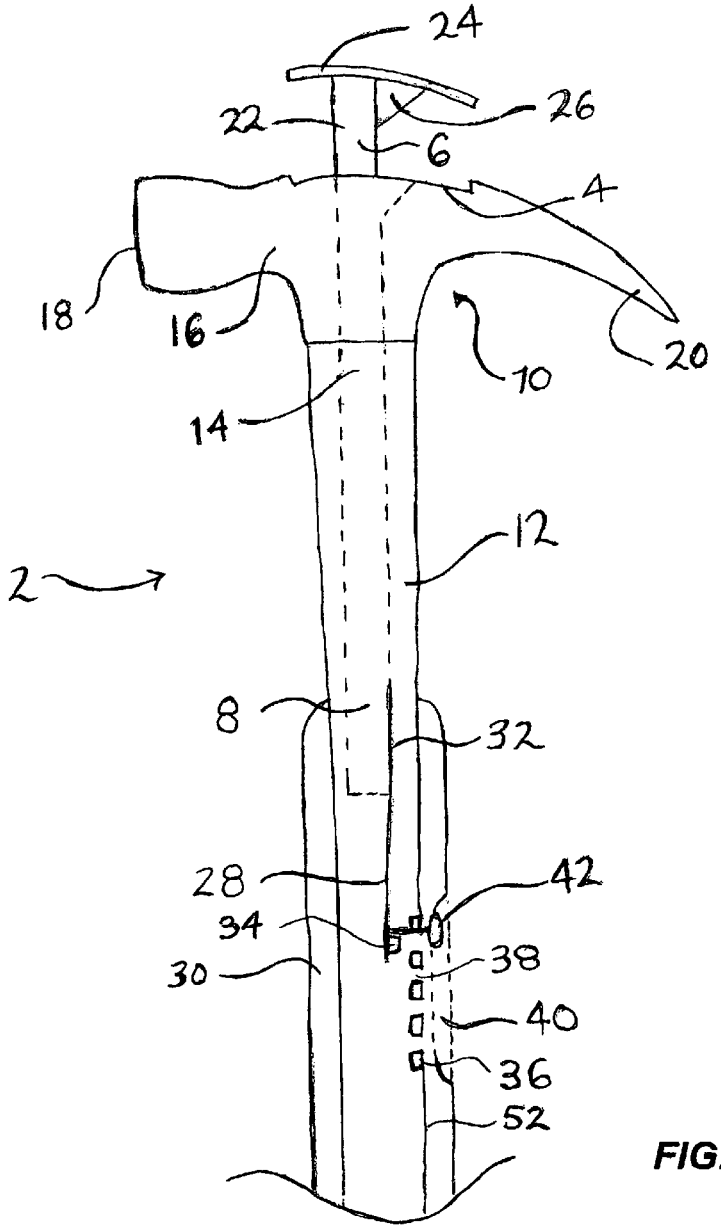
FIG. 2 is a side elevation view of the device with fulcrum extended, according to the invention.

FIG. 2 shows the device with fulcrum extended, according to the invention. The rocker plate 24 is extended above the top margin of the head 10 by approximately one inch. The rocker plate 24 is curved, planar, and generally rectangular in shape. The plate 24 is formed from a metal which may be the same metal as used in the head 10 or a different metal or composite material. The plate 24 is affixed to an extension rod 22. The rod 22 is metallic and shaped for slidable insertion into a shaft opening 14 formed within the head 10 and handle 12. The plate 24 and rod 22 may be separate parts or may be die cast as a single part. The rod 22 may be constructed of any suitable or desired material, including metal, wood, and composite materials. Any suitable or desired length of rod may be utilized. The cross-sectional shape of the rod 22 may be square, rectangular, oval or circular, provided the shape of the rod 22 corresponds to the shape of the shaft opening 14 for secure, but slidable movement of the rod 22 within the shaft opening 14. The shaft opening 14 may be of a single diameter or multiple diameters, as suitable or desired for slidable movement of the rod 22 and weight distribution along the length of the device 2.

Figure 4A:
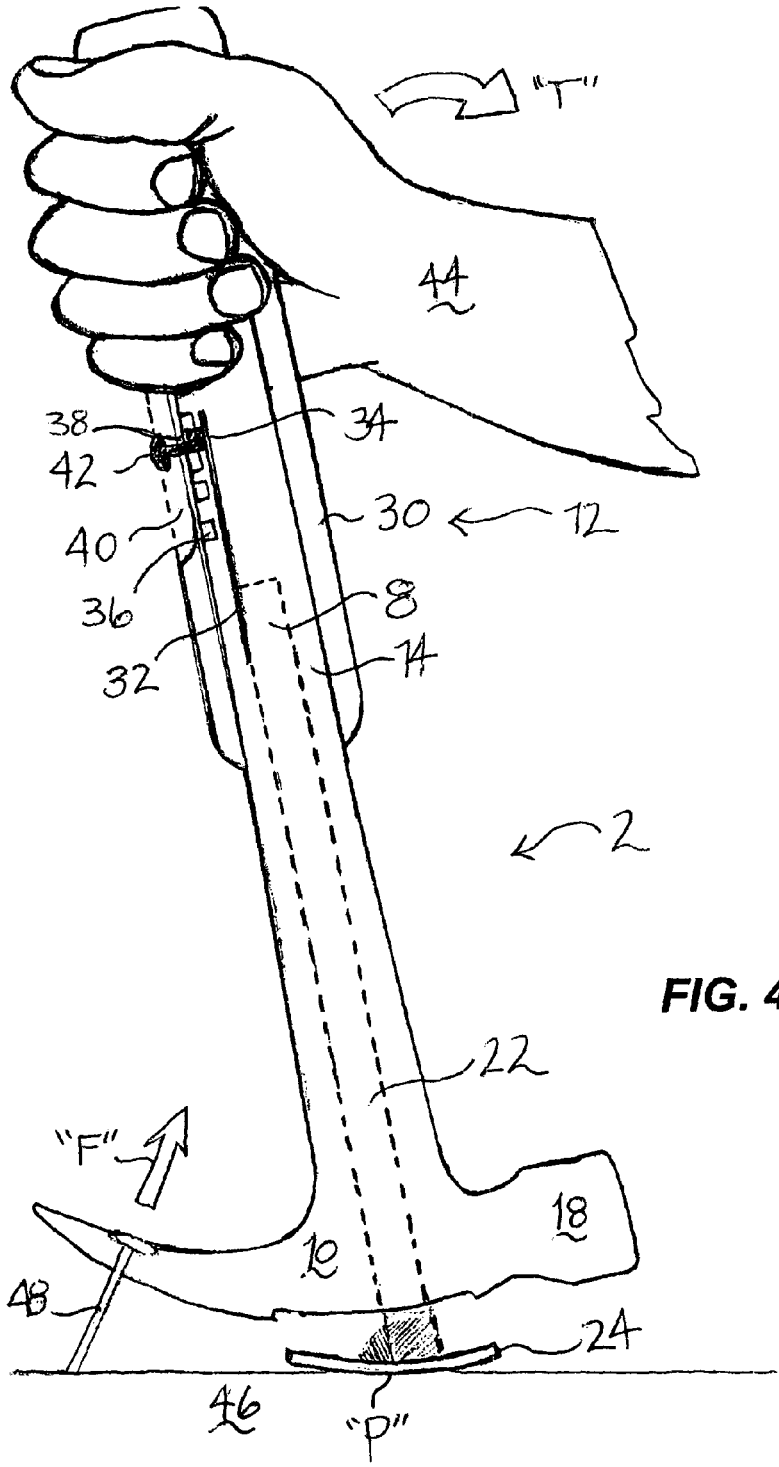
Figure 4B:
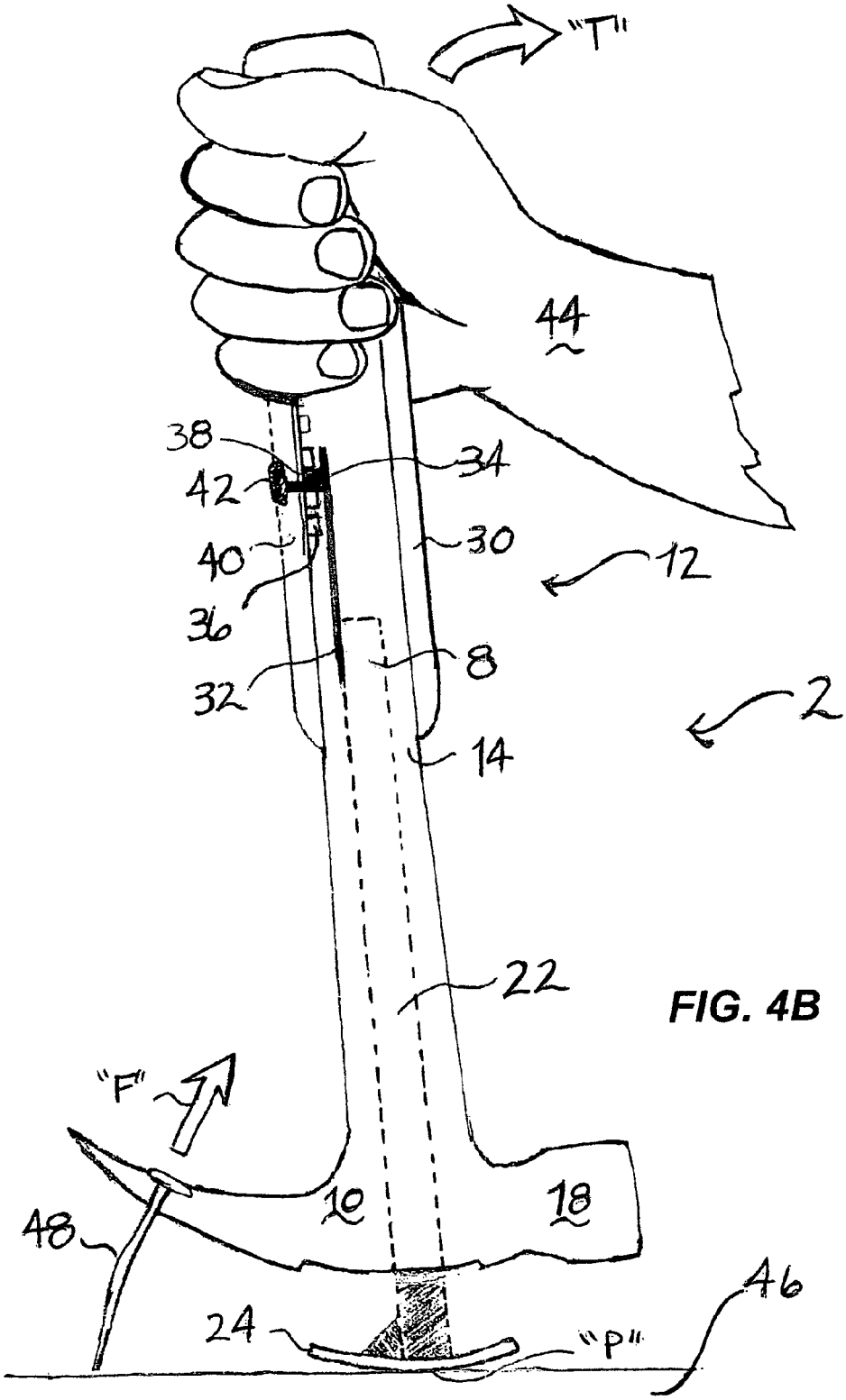
Figure 4C:
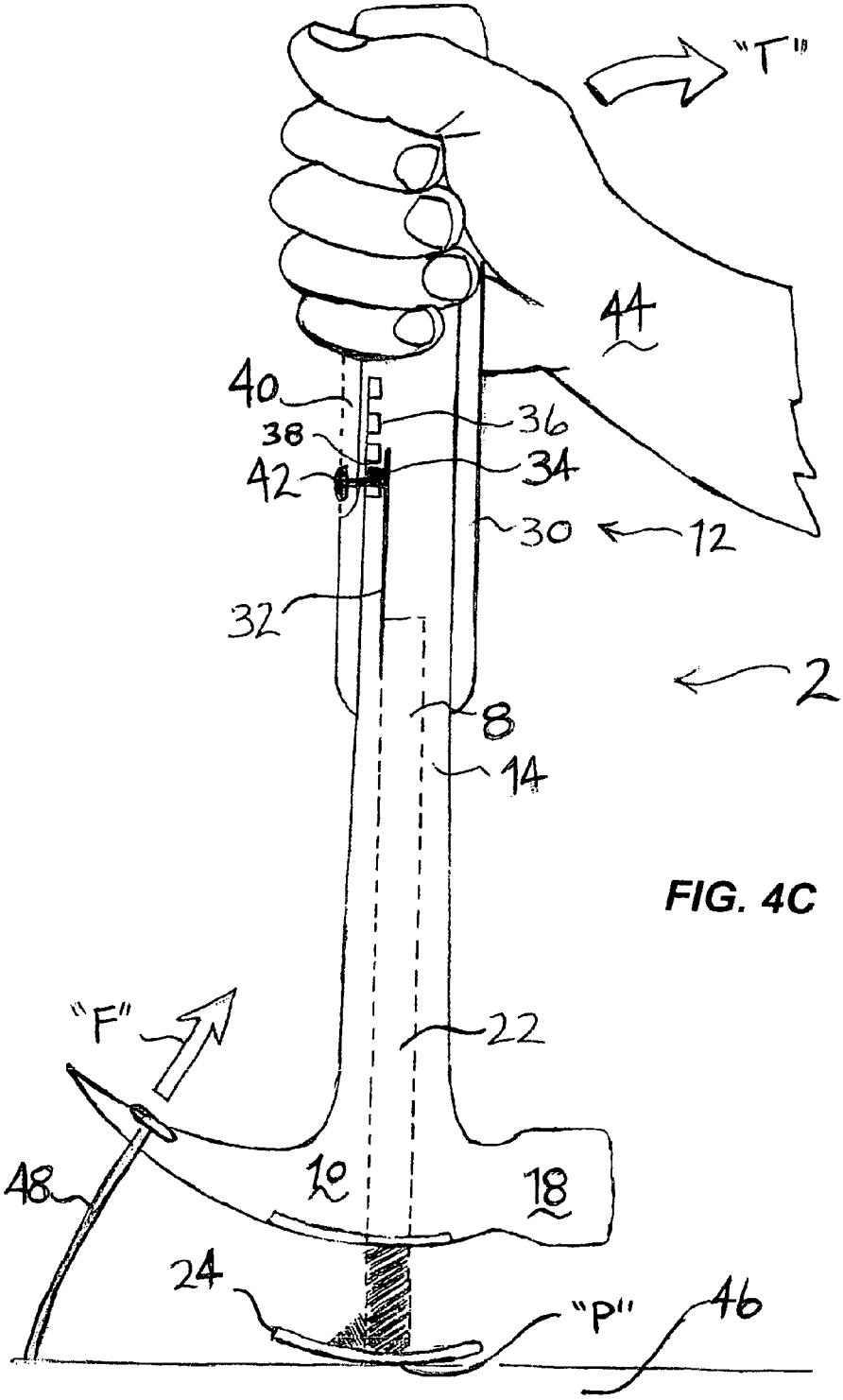

Referring to FIG. 2, the concave, planar surface of the rocker plate 24 not only allows for concealment of the plate 24 within the top margin of the head 10, but also provides an adequate and even surface for pivot movement of the device 2 when being used to remove a nail as shown in FIGS. 4A-4C. The unique shape and size of the rocker plate 24 allows for smooth rocking of the device 2 across the pivot point and prevents the plate 24 from denting, piercing or otherwise leaving marks in the material from which the nail is being removed. A smooth rocking pivot point is particularly useful when removing nails or fasteners from soft materials, such as soft woods or sheetrock. The rocker plate 24 may further comprise a pad (not shown) extending along its external margin to provide additional protection to the material from which nails are being removed. The pad may be constructed of rubber, plastic, or any suitable or desired material and may be striated or notched for improved grip and traction.

Referring to FIG. 2, the plate 24 is reinforced with a triangular-shaped gusset 26. The gusset 26 increases the strength of the rocker plate 24 when the hammer 2 is used to extract a deeply embedded nail. The gusset 26 is affixed to the fulcrum rod 22 and spans from the fulcrum rod 20 to the base of the rocker plate 24 (towards the claw end 20 of the head 10). The pivot region opening 4 is further defined by a recessed shape corresponding to the shape of the gusset 26. The pivot region opening 4 so formed permits flush retraction of the rocker plate 24 for concealment of the plate and rod assembly 24/22 within the hammer head 10 and handle 12.

The gusset is metallic for added strength, but may be a different metal from that used to form the rocker plate 24 and/or head, and/or may be formed from a sufficiently strong composite material. The gusset 26 is die cast as an integral part of the rocker plate 24 and rod 22 assembly, but alternately may be welded thereto. While the gusset 26 shown in FIG. 2 is triangular in shape, the gusset 26 may be of any suitable or desired shape, including that of a curved wedge.

Referring to FIG. 2, a release tab 42 is affixed to an elongated spring steel tab 32 which, in turn, is affixed proximate the base end 8 of the rod 22. The spring steel tab 32 is welded to the rod 22 or otherwise firmly affixed thereto. The spring steel tab 32 extends from the base 8 of the rod 22 to allow for bending of the tab 32 by a user via manual depression of the release tab 42, as discussed in connection with FIGS. 3B-D.

Referring to FIGS. 1 and 2, the release tab 42 is shown in FIG. 1 at a lower position within the tab slide region 40, and in FIG. 2, the release tab 42 has been moved to a higher position (moved towards the head 10) within the tab slide region 40. As discussed in connection with FIGS. 3A-3D, the amount (distance) of movement of the tab 42 between FIGS. 1 and 2 corresponds to the amount (distance) of extension of the rod and rocker plate 22/24 above the top margin of the head 10.

Referring to FIGS. 1 and 2, in an alternate embodiment, the rocker plate 24 is modified to include a narrow elongated slot opening (not shown) formed in the portion of the rocker plate 24 proximate the claw 20 of the hammer 2. The slot opening is centered on the plate 24 and extends along a horizontal axis to mirror the larger cleft formed between the arms of the claw 20. The slot opening may be cleft-shaped and angled, as in a typical claw hammer, or be shaped in the form of an elongated rectangle with right angle corners. The rocker plate 24 slot opening may be used to remove nails of a smaller shank diameter and/or nail head size in the same manner as the larger claw 20.

In use, the rocker plate 24 slot opening is slidably positioned and firmly seated around the shank of an embedded nail, and the hammer 2 is rotated to pull on the nail, thereby removing the nail with little effort. The slot opening may be utilized where the longer and larger claw 20 cannot physically fit within a confined space and/or where the nail to be removed is small, has a small head (such as a finishing nail) and/or lacks a head due to the head having been removed through prior unsuccessful nail removal efforts. The strength of the rocker plate 24 is not compromised due to the narrow shape and design of the slot opening.

Figure 3A:
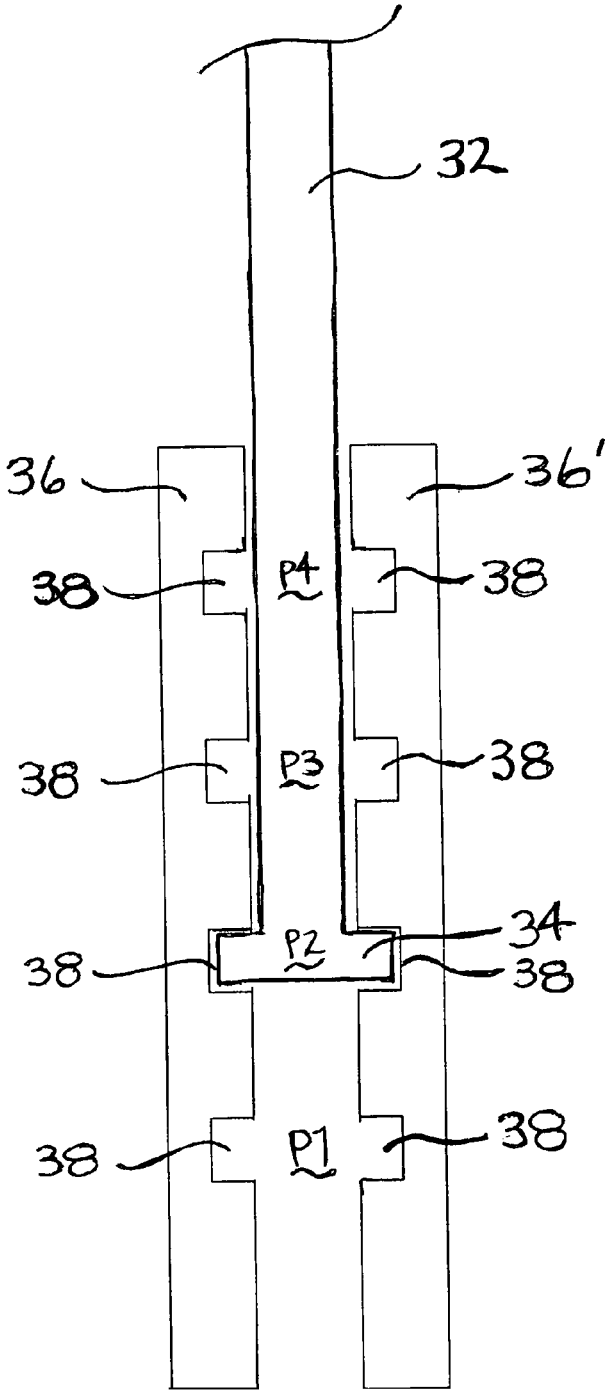
FIG. 3A is a front elevation view of opposed spaced T-guides defining a series of T-guide recesses for insertion of the T-clip base of the spring steel tab, according to the invention.

FIG. 3A shows a front elevation view of the spring steel tab 32 with a T-clip base 34 and opposed spaced T-guides 36, 36' defining a series of opposed T-guide recesses 38 for slidable insertion of the T-clip 34. Referring to FIG. 3A, the spring steel tab 32 has a T-shaped ending, or T-clip 34, formed at its base adjacent to the release tab 42 (shown in FIG. 2). The T-clip 34 shown in FIG. 3A is shaped for slidable insertion and secure retention within openings 38 defined by opposed spaced T-guides 36, 36' extending laterally into the shaft opening 14 (shown in FIGS. 3B-D).

Referring to FIGS. 1, 2 and 3A, the T-guides 36, 36' are affixed to the internal wall 52 of the shaft opening 14 or die cast as an integral part of the internal wall 52. Four spaced recesses 38 are shown in FIG. 3A. The four spaced openings 38 represent four possible locked positions for the rod 22. The initial position at the bottom (labeled "P1") locks the plate 24 in a retracted position within the pivot opening 4 as shown in FIG. 1. The next three positions ("P2", "P3", "P4") extend and lock the plate 24 outside the margin of the head 10. Any suitable or desired number, shape or size of T-clips 34, T-guides 36, 36' and/or T-guide recesses 38 may be utilized.

Figure 3B:
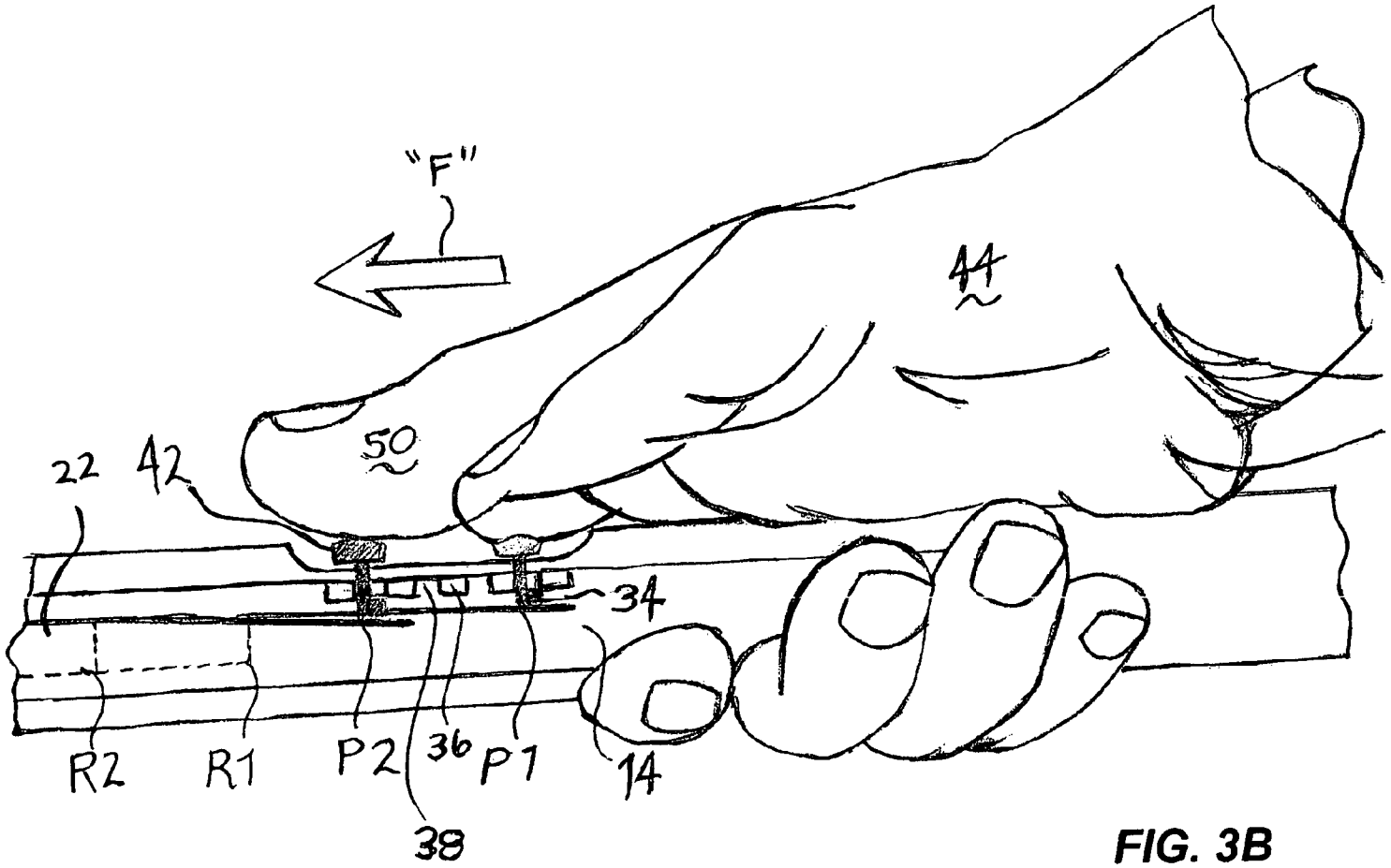
FIGS. 3B-3D are side elevation partial cross-sectional views of the device showing adjustment of the fulcrum through application of pressure and axial movement of a release tab by a user's thumb, according to the invention; and, FIGS. 4A-4C are side elevation cross-sectional views of the device held by a user in the process of removing nails at differing lengths, according to the invention.
Figure 3C:
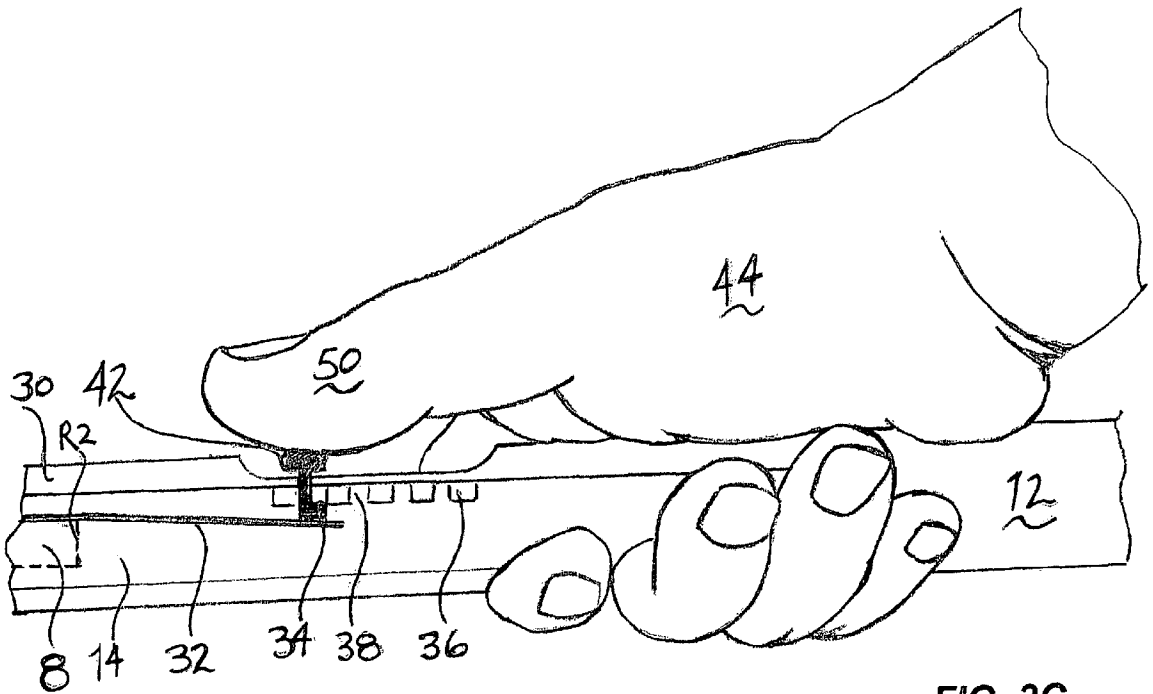
Figure 3D:
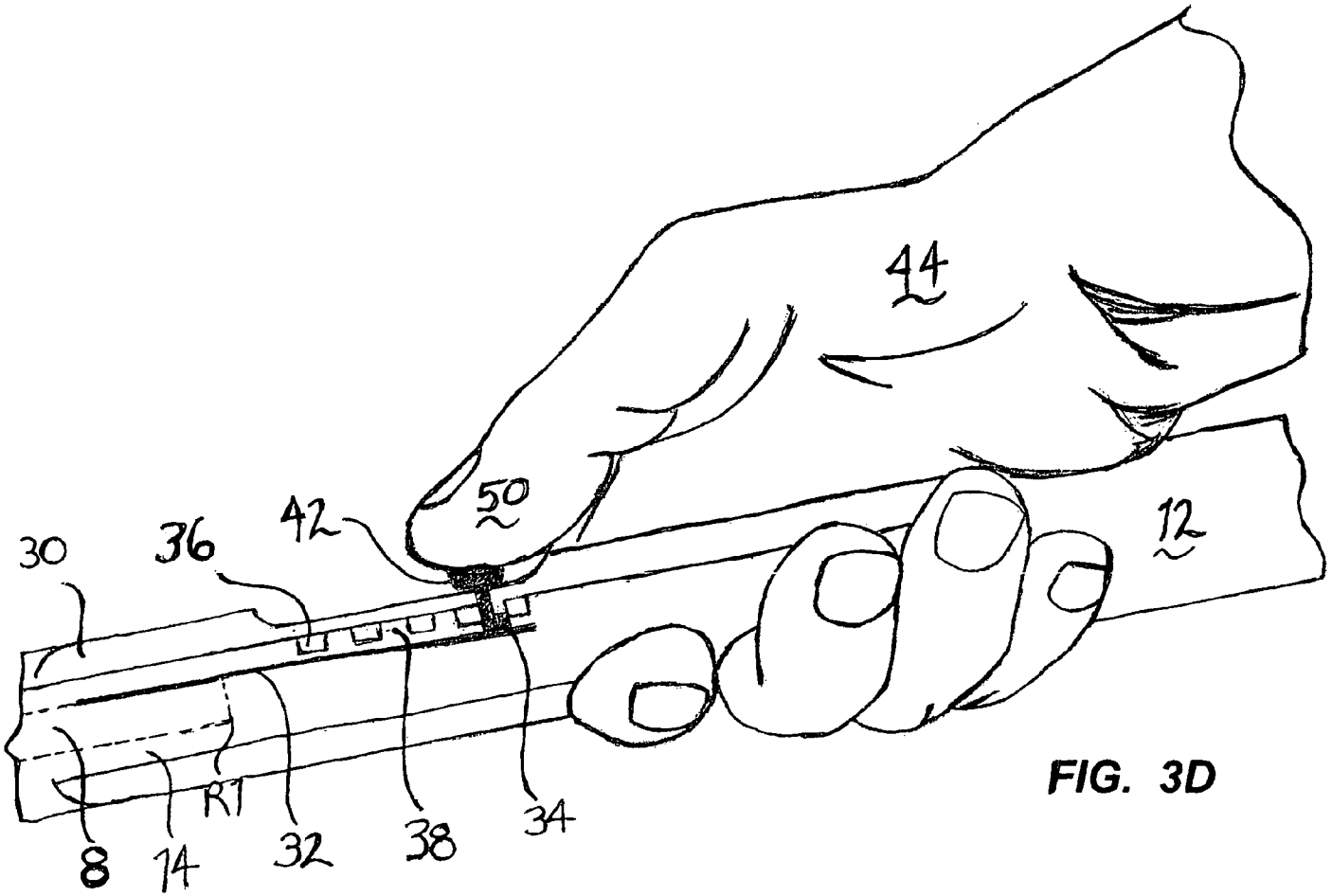

FIGS. 3B-3D are side elevation partial views of the device 2 being adjusted through application of pressure and axial movement of the release tab 42 by a user's 44 thumb 50. In general, manual depression of the release tab 42 bends the tab 42 into the shaft opening 14 and pushes the T-clip 34 out of (beneath) the T-guide recess 38. Once the T-clip 34 is removed from the T-guide recess 38, a user 44 may push up or pull down on the release tab 42 (using the user's thumb 50) to slidably adjust the rod 22 to a desired position. Conversely, manual release of the tab 42 causes the spring steel tab 32 to bend towards the tab slide region 40 which in turn pushes the T clip 34 into a T-guide recess 38. Once the T-clip 34 is securely inserted within and retained by a T-guide recess 38, the rod 22 is locked into position and the device 2 is ready for continued use.

FIG. 38 shows sliding movement of the release tab 42 by application of thumb pressure 50 by a user 44. "P1" represents the original position of the release tab 42 with T-clip 34 inserted into a T-guide recess 38 formed between the T-guides 36, 36'. "R1" represents the original position of the extension rod 22 within the shaft opening 14. Referring to FIG. 3B, the user 44 manually depresses the release tab 42 with the user's thumb 50 to release the T-clip 34. The user 44 then pushes the tab 42 in a forward direction (arrow "F") to move the tab 42 in the direction of the hammer head 10 (shown in FIGS. 1 and 2).

Referring to FIG. 3B, "P2" represents a second position of the release tab 42 at which time the user 44 releases the manual pressure applied to the tab 42. Upon release of manual pressure, the T-clip 34 adjacent to the tab 42 is positioned above a T-guide recess 38. Upon complete release of the tab 42, the T-clip 34 is pushed by the spring steel tab 32 into the T-guide recess 38 and retained therein. Once the T-clip 34 is retained within the T-guide recess 38, the rod 22 is locked into position "R2".

Referring to FIGS. 3C and 3D, the operation described in connection with FIG. 3B may be reversed to retract the rod 22 to its original position of "R1." As a result, the adjustment of the rocker plate 24 to a desired position is accomplished with use of the thumb on one hand. The user's hand 44 never has to leave the handle 12. The user 44 maintains a firm grip on the device 2 at all times. The slidable movement of the rod 22 allows for quick adjustment to the desired distance of fulcrum extension. A user 44 may visually gauge the distance a nail or other fastener is protruding from material and quickly and effectively adjust the rocker plate 24 to the desired position.

FIGS. 4A through 4C show the device 2 in operation to remove nails exposed from a construction material at different lengths. FIG. 4A shows the device 2 held by the right hand of a user 44 in the process of removing a nail 48 partially embedded in a construction material such as a wooden board 46. The release tab 42 has been shifted towards the head 10 to extend the rod 22 and plate 24 above the margin of the head 10. The partially extended rocker plate 24 is set against the plane of wood 46 from which a partially extended nail 48 is being removed. The T-clip 34 adjacent the release tab 42 has been depressed, moved, and released into a second T-guide recess 38 to lock the rod 22 and plate 24 into the partially extended position. The nail 48 is inserted within the cleft formed by the dual-pronged claws 20. A generally upward force "F" is being applied to the head of the nail 48 as it is pulled out of the board 46.

Referring to FIG. 4A, a typical hammer has a fixed fulcrum pivot point on the outer curve of the hammer head against which the hammer is pivoted when removing a nail. The proximity of the pivot point to the nail shaft corresponds to the amount of torque (force) that can be applied to the nail. Consequently, the closer the pivot point is positioned relative to the nail, the stronger the torque on the nail, and the smoother and easier the removal of the nail is for the hammer user. For the partially extended nail 48 shown in FIG. 4A, the pivot point "P" is shifted away (at a further distance) from the nail shaft 48. However, the extended plate 24 shifts the pivot point "P" closer to the nail 48. The shorter distance between the nail 48 and pivot point "P" allows for greater torque "T" and a greater resulting force "F" to be applied to the nail 48 with corresponding easier and smoother removal of the nail 48.

FIG. 4B shows the device 2 being used to remove a nail 48 that is further extended from the wooden board 46. The plate 24 and rod 22 are extended further above the top margin of the hammer head 10 than as shown in FIG. 4A. As shown in FIG. 4B, a longer length of nail extending from the board 46 requires a longer extension of the rod 22 and plate 24 in order to provide a pivot point "P" close enough to the nail 48 for sufficient torque "T" and resulting force "F" on the nail 48. The extended plate 24 is set against the plane of wood 46 from which the extended nail 48 is being removed. The T-clip 34 adjacent the release tab 42 has been moved and released into a third T-guide recess 38 to lock the rod 22 and plate 24 into the extended position as shown. The nail 48 is inserted between the dual-pronged claws 20. A generally upward force "F" is being applied to the head of the nail 48 as it is pulled out of the board 46. The extended plate 24 shifts the location of the pivot point "P" closer to the nail thereby providing the user 44 sufficient torque "T" to pull the nail 48 out smoothly and with noticeably less effort.

FIG. 4C shows the device 2 being used to remove a nail 48 that is even further extended from the wooden board 46. The plate 24 and rod 22 are extended to their full extent above the top margin of the hammer head 10. The longer length of nail 48 shown in FIG. 4C requires an even longer extension of the rod 22 and plate 24 in order to provide a pivot point "P" close enough to the nail 48 for sufficient torque "T" and resulting force "F" on the nail 48. As with FIGS. 4A and 4B, the extended plate 24 shown in FIG. 4C is set against the plane of wood 46 from which the extended nail 48 is being removed. The T-clip 34 adjacent the release tab 42 has been depressed, slidably moved, and released into a fourth and final T-guide recess 38 to lock the rod 22 and plate 24 into the extended position as shown. The nail 48 is inserted between the dual-pronged claws 20. A generally upward force "F" is being applied to the head of the nail 48 as it is pulled out of the board 46. The extended plate 24 shifts the location of the pivot point "P" closer to the nail thereby providing the user 44 sufficient torque "T" to pull the nail 48 out smoothly and with noticeably less effort.

INDUSTRIAL APPLICABILITY

It is clear that the inventive Hammer With Concealed Adjustable Fulcrum of this application has wide applicability to the construction and home improvement industries, namely to provide a tool that has the appearance and utility of a normal hammer combined with an adjustable fulcrum single-handedly operable with the user's thumb. The device does not require a user to shift his or her hand away from the handle to adjust the fulcrum. The single handed operation is a substantial safety feature, for example, where a user is standing on a ladder and needs at least one hand at all times to remain stabilized in the work environment.

Moreover, the fulcrum may be adjusted and securely locked into at least three separate extended positions depending on the length of the protruding nail to be removed. The design stays within the existing margins of the tool without protruding parts that might interfere with normal use. The rocker plate is shaped to conform to the top margin of the head, and as such, simulates the feel of the head during use. The torque applied to the handle is carried to the plate in the same manner as a normal hammer, thereby simulating the feel of a normal hammer while providing significantly more force to nail or fastener removal.

It should be understood that various modifications within the scope of this invention can be made by one of ordinary skill in the art without departing from the spirit thereof and without undue experimentation. For example, any suitable or desired materials may be used for the parts disclosed in this application; the parts may be welded, saudered or die cast. The design of the hammer head, handle and claw may be modified from that shown in the figures. Adjustments may be made to the size and weight of the rod, plate and shaft to distribute weight in a desired manner. The number and spacing between the extendable locked positions may be adjusted as desired. This invention is therefore to be defined as broadly as the prior art will permit, and in view of the specification if need be, including a full range of current and future equivalents thereof.

We claim:

1. A hammer having a concealed adjustable fulcrum, comprising:

a head comprising a face, a claw, and a pivot region opening;

a handle fixed to the head comprising a tab slide region opening;

a shaft opening formed within the head and handle;

an extension rod comprising a first distal end and a second proximal end, said first end shaped to form a rocker plate capable of flush recession within the pivot region opening, and said second end shaped for slidable insertion within the shaft opening;

an elongated spring tab affixed proximate the second end of the rod;

a T-clip and release tab affixed proximate a base end of said spring tab, said release tab extending laterally into the tab slide region;

said T-clip shaped for insertion, retention and release into and out of a plurality of spaced T-guide recesses formed by opposed spaced T-guides affixed to the shaft opening and extending internally into the shaft opening.

2. The hammer of claim 1, wherein a manual depression of the release tab bends the spring tab into the shaft opening and removes the T-clip from a T-guide recess allowing manual axial movement of the release tab with corresponding slidable adjustment of the rod and rocker plate to a desired position.

3. The hammer of claim 1, wherein a manual release of the release tab causes the spring tab to bend towards the tab slide region thereby inserting the T-clip into the T-guide recess to lock the rod and corresponding rocker plate into a desired position.

4. The hammer of claim 1, wherein the pivot region opening is defined by an elongated shallow generally rectangular-shaped concave recess in the head.

5. The hammer of claim 1, wherein the tab slide region opening is defined by an elongated shallow generally oval-shaped recess in the handle.

6. The hammer of claim 1, wherein the shaft opening comprises two opposed, spaced T-guides defining a plurality of opposed, spaced T-guide recess openings shaped for secure retention of the T-clip.

7. The hammer of claim 1, wherein the handle further comprises an outer rubber grip material and the tab slide region is recessed within said material.

8. The hammer of claim 1, wherein the rocker plate further comprises a gusset.

9. The hammer of claim 1, wherein the rocker plate further comprises a pad.

10. The hammer of claim 1, wherein the rocker plate further comprises a slot opening.

11. The hammer of claim 1, wherein the rocker plate is shaped to conform to the top margin of the head to simulate a feel of the head during removal of a nail by a user.

12. The hammer of claim 1, wherein the rocker plate is extendably adjustable to a plurality of desired locked positions.

13. The hammer of claim 1, wherein the rocker plate is extendably adjustable to a plurality of locked positions, each of said positions decreasing a distance between a pivot point of the rocker plate, on the one hand, and a point of engagement between the claw and a nail, on the other hand.

14. The hammer of claim 1, wherein the rocker plate is selectively extendably adjustable to a plurality of positions via single-handed thumb operation of the release tab by a user.

15. The hammer of claim 1, selected from the group consisting of: common nail hammer with curved claw, rip hammer with straight claw, framing hammer, finishing hammer, tack hammer.

* * * * *